US005701392A

United States Patent [19]

Adoul et al.

[11] Patent Number: 5,701,392

[45] Date of Patent: Dec. 23, 1997

[54] DEPTH-FIRST ALGEBRAIC-CODEBOOK SEARCH FOR FAST CODING OF SPEECH

[75] Inventors: Jean-Pierre Adoul; Claude Laflamme, both of Sherbrooke, Canada

[73] Assignee: Universite de Sherbrooke, Sherbrooke, Canada

[21] Appl. No.: 509,525

[22] Filed: Jul. 31, 1995

Related U.S. Application Data

[63] Continuation-in-part of Ser. No. 401,785, Mar. 10, 1995, which is a continuation-in-part of Ser. No. 927,528, filed as PCT/CA90/00381, Nov. 6, 2990 , Pat. No. 5,444,816.

[30] Foreign Application Priority Data

Feb. 23, 1990 [CA] Canada ..... 2010830

[51] Int. Cl.[6] ..... G10L 3/02

[52] U.S. Cl. ..... 395/2.28; 395/2.32; 395/2.71

[58] Field of Search ..... 395/2.28, 2.32, 395/2.71, 2.1, 2.09

[56] References Cited

U.S. PATENT DOCUMENTS

| | | | |
|---|---|---|---|
| 4,401,855 | 8/1983 | Broderson et al. | 179/15.55 R |
| 4,486,899 | 12/1984 | Fushikida | 381/36 |
| 4,520,499 | 5/1985 | Montlick et al. | 381/36 |
| 4,594,687 | 6/1986 | Kaneko et al. | 364/900 |
| 4,625,286 | 11/1986 | Papamichalis et al. | 364/513.5 |
| 4,669,120 | 5/1987 | Ono | 381/40 |
| 4,677,671 | 6/1987 | Galand et al. | 381/31 |
| 4,680,797 | 7/1987 | Benke | 381/41 |
| 4,710,959 | 12/1987 | Feldman et al. | 381/36 |
| 4,720,861 | 1/1988 | Bertrand | 381/36 |

(List continued on next page.)

FOREIGN PATENT DOCUMENTS

| | | | |
|---|---|---|---|
| 0 446 817 | 9/1981 | European Pat. Off. | G10L 9/14 |
| 0 138 061 | 4/1985 | European Pat. Off. | G10L 7/08 |
| 0 149 724 | 7/1985 | European Pat. Off. | G10L 9/14 |
| 0 342 687 | 11/1989 | European Pat. Off. | G10L 9/14 |
| 0 514 912 A3 | 11/1992 | European Pat. Off. | G10L 9/18 |
| 0 532 225 A2 | 3/1993 | European Pat. Off. | G10L 5/00 |
| 0 545 386 | 6/1993 | European Pat. Off. | G10L 9/14 |
| PCT/CA90/ 00381 | 11/1990 | WIPO | G10L 9/14 |
| WO 91/13432 | 9/1991 | WIPO | G10L 9/14 |

OTHER PUBLICATIONS

Leflamme, et al., "On Reducing Computational Complexity of Codebook Search in CELP Coder Through the Use of Algebraic Codes", Proceedings of the IEEE ICASSP 1990, pp. 177–180.

Abstract of "Low delay speech coding", Cuperman, et al., Journal Speech Communication, vol. 12, No. 2, Netherlands, Jun. 1993, pp. 193–204.

(List continued on next page.)

*Primary Examiner*—Allen R. MacDonald
*Assistant Examiner*—Richemond Dorvil
*Attorney, Agent, or Firm*—Merchant, Gould, Smith, Edell, Welter & Schmidt, P.A.

[57] ABSTRACT

A codebook is searched in view of encoding a sound signal. This codebook consists of a set of codevectors each of 40 positions and comprising N non-zero-amplitude pulses assignable to predetermined valid positions. To reduce the search complexity, a depth-first search is used which involves a tree structure with levels ordered from 1 through M. A path-building operation takes place at each level whereby a candidate path from the previous level is extended by choosing a predetermined number of new pulses and selecting valid positions for said new pulses in accordance with a given pulse-order rule and a given selection criterion. A path originated at the first level and extended by the path-building operations of subsequent levels determines the respective positions of the N non-zero-amplitude pulse of a candidate codevector. Use of a signal-based pulse-position likelihood estimate during the first few levels enable initial pulse-screening to start the search on favorable conditions. A selection criterion based on maximizing a ratio is used to assess the progress and to choose the best one among competing candidate codevectors.

31 Claims, 6 Drawing Sheets

U.S. PATENT DOCUMENTS

| | | | |
|---|---|---|---|
| 4,724,535 | 2/1988 | Ono | 375/122 |
| 4,742,550 | 5/1988 | Fette | 381/36 |
| 4,764,963 | 8/1988 | Atal | 381/36 |
| 4,771,465 | 9/1988 | Bronson et al. | 381/36 |
| 4,797,925 | 1/1989 | Lin | 381/36 |
| 4,797,926 | 1/1989 | Bronson et al. | 381/36 |
| 4,799,261 | 1/1989 | Lin et al. | 381/36 |
| 4,811,398 | 3/1989 | Copperi et al. | 381/37 |
| 4,815,134 | 3/1989 | Picone et al. | 381/31 |
| 4,817,157 | 3/1989 | Gerson | 381/40 |
| 4,821,324 | 4/1989 | Ozawa et al. | 381/31 |
| 4,858,115 | 8/1989 | Rusterholz et al. | 364/200 |
| 4,860,355 | 8/1989 | Copperi | 381/36 |
| 4,864,620 | 9/1989 | Bialick | 381/34 |
| 4,868,867 | 9/1989 | Davidson et al. | 381/36 |
| 4,873,723 | 10/1989 | Shibagaki et al. | 381/34 |
| 4,964,169 | 10/1990 | Ono | 381/40 |
| 4,991,214 | 2/1991 | Freeman et al. | 381/38 |
| 5,097,508 | 3/1992 | Steude et al. | 381/36 |
| 5,193,140 | 3/1993 | Minde | 395/2 |
| 5,293,449 | 3/1994 | Tzeng | 395/2.32 |
| 5,307,441 | 4/1994 | Tzeng | 395/2.31 |
| 5,457,783 | 10/1995 | Chhatwal | 395/2.28 |
| 5,667,340 | 9/1997 | Arjmand et al. | 381/31 |

OTHER PUBLICATIONS

"A robust 16 Kbits/s vector adaptive predictive coder for mobile communications" A. Le Guyader et al. ICASSP 86 Proceedings, Apr. 7–11, 1986, Tokyo, Japan pp. 857–860.

"A comparison of some algebraic structures for CELP coding of speech" J–P. Adoul et al. ICASSP 87 Proceedings, Apr. 6–9, 1987, Dallas, Texas pp. 1953–1956.

"Fast CELP coding based on algebraic codes" J–P. Adoul et al. ICASSP 87 Proceedings Apr. 6–9, 1987, Dallas Texas pp. 1957–1960.

"Multipulse excitation codebook design and fast search methods for CELP speech coding" F.F. Tzeng IEEE Glob. Telecom. Conf. & Exhib., No. 28–Dec. 1, 88 Hollywood Fla, pp. 0590–0594.

"Coding of Speech at 8 kbit/s using Conjugate–structure Algebraic–code–excited Linear–Predictive (CS–ACELP) Coding" Study Group 15 contrib., Int. Telecom. Union Jun. 1995, pp. 1–43.

"8 kbits/s Speech Coder with Pitch Adaptive Vector Quantizer" S. Iai and K. Irie, ICASSP 1986, Tokyo, vol. 3, Apr. 1986, pp. 1697–1700.

"Fast Methods for Code Search in CELP" M.E. Ahmed and M.I. Al–Suwaiyel, IEEE Transactions on Speech and Audio Processing, 1993, vol. 1, No. 3, New York, pp. 315–325.

"Algorithme de quantification vectorielle sphérique à partir du réseau de Gosset d'ordre" C. Lamblin et J.P. Adoul , Annales des Télécommunications, 1988, vol. 43, No. 1–2, pp. 172–186.

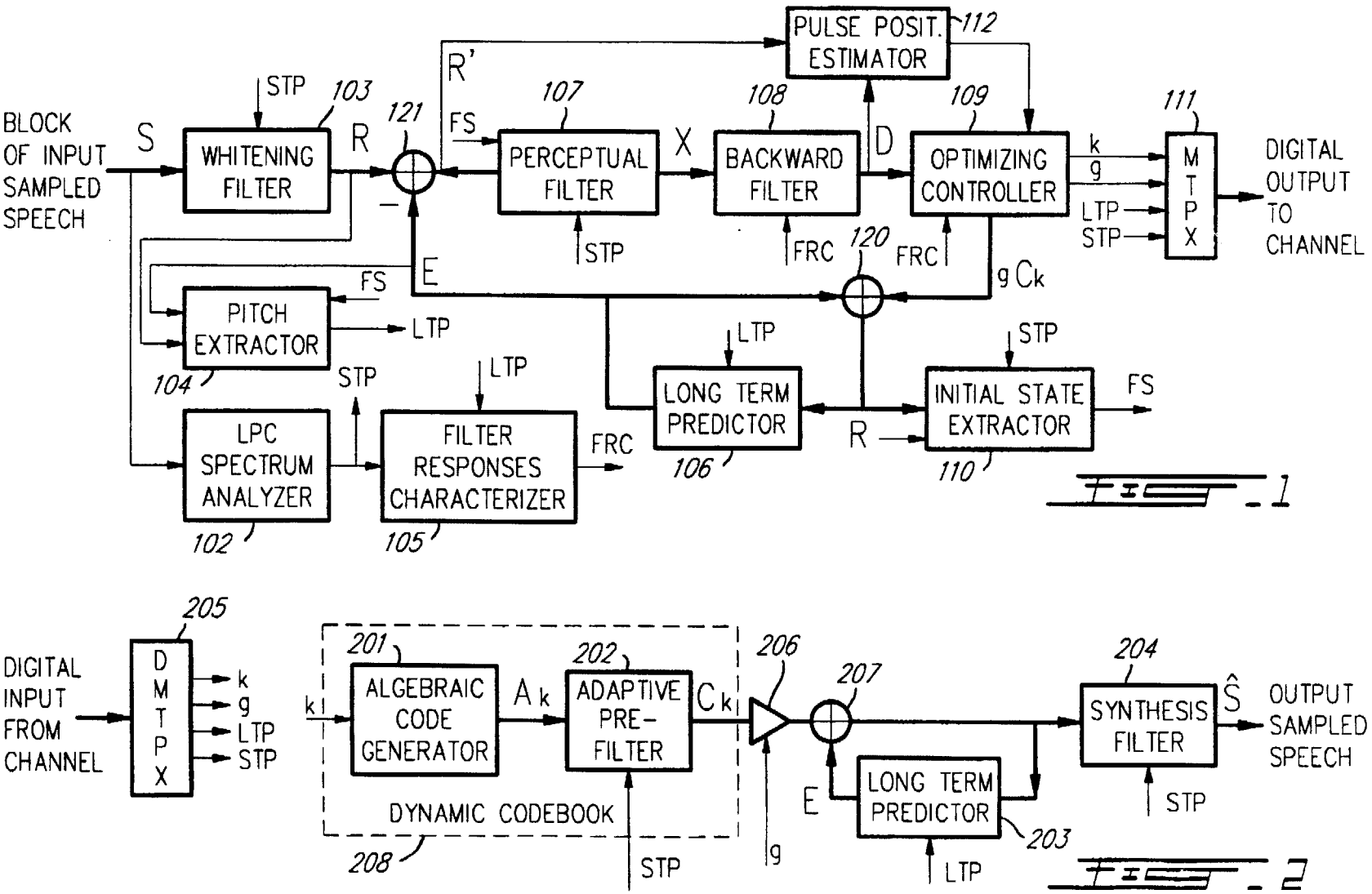
BLOCK OF INPUT SAMPLED SPEECH
S
WHITENING FILTER
STP
103
R
121
R'
FS
PERCEPTUAL FILTER
107
STP
X
BACKWARD FILTER
108
FRC
PULSE POSIT. ESTIMATOR
112
D
OPTIMIZING CONTROLLER
109
FRC
k
g
LTP
STP
MTPX
111
DIGITAL OUTPUT TO CHANNEL
E
PITCH EXTRACTOR
104
LTP
FS
LPC SPECTRUM ANALYZER
102
STP
FILTER RESPONSES CHARACTERIZER
105
LTP
FRC
LONG TERM PREDICTOR
106
LTP
120
g Ck
R
INITIAL STATE EXTRACTOR
110
STP
FS
1
DIGITAL INPUT FROM CHANNEL
DMTPX
205
k
g
LTP
STP
ALGEBRAIC CODE GENERATOR
201
k
Ak
ADAPTIVE PRE-FILTER
202
STP
Ck
DYNAMIC CODEBOOK
208
206
g
207
E
LONG TERM PREDICTOR
203
LTP
SYNTHESIS FILTER
204
STP
Ŝ
OUTPUT SAMPLED SPEECH
2

EXHAUSTIVE NESTED-LOOP SEARCH

THRESHOLD-PRUNED NESTED-LOOP SEARCH

DEPTH-FIRST ALGEBRAIC-CODEBOOK SEARCH FOR FAST CODING OF SPEECH

RELATED U.S. PATENT APPLICATION

This is a Continuation-In-Part of U.S. patent application Ser. No. 08/401,785 filed on Mar. 10, 1995 for an invention entitled "DEPTH-FIRST ALGEBRAIC-CODEBOOK SEARCH FOR FAST CODING OF SPEECH" which is a continuation in part of application Ser. No. 07/927,528 filed as PCT/CA90/00381 Nov. 6, 1990, U.S. Pat. No. 5,444,816.

BACKGROUND OF THE INVENTION

1. Field of the Invention

The present invention relates to an improved technique for digitally encoding a sound signal, in particular but not exclusively a speech signal, in view of transmitting and synthesizing this sound signal.

2. Brief Description of the Prior Art

The demand for efficient digital speech encoding techniques with a good subjective quality/bit rate tradeoff is increasing for numerous applications such as voice transmission over satellites, landmobile, digital radio or packed network, voice storage, voice response and wireless telephony.

One of the best prior art techniques capable of achieving a good quality/bit rate tradeoff is the so called Code Excited Linear Prediction (CELP) technique. According to this technique, the speech signal is sampled and processed in successive blocks of L samples (i.e. vectors), where L is some predetermined number. The CELP technique makes use of a codebook.

A codebook, in the CELP context, is an indexed set of L-sample-long sequences which will be referred to as L-dimensional codevectors. The codebook comprises an index k ranging from 1 to M, where M represents the size of the codebook sometimes expressed as a number of bits b:

$$M=2^b$$

A codebook can be stored in a physical memory (e.g. a look-up table), or can refer to a mechanism for relating the index to a corresponding codevector (e.g. a formula).

To synthesize speech according to the CELP technique, each block of speech samples is synthesized by filtering the appropriate codevector from the codebook through time varying filters modeling the spectral characteristics of the speech signal. At the encoder end, the synthetic output is computed for all or a subset of the codevectors from the codebook (codebook search). The retained codevector is the one producing the synthetic output which is the closest to the original speech signal according to a perceptually weighted distortion measure.

A first type of codebooks are the so called "stochastic" codebooks. A drawback of these codebooks is that they often involve substantial physical storage. They are stochastic, i.e. random in the sense that the path from the index to the associated codevector involves look-up tables which are the result of randomly generated numbers or statistical techniques applied to large speech training sets. The size of stochastic codebooks tends to be limited by storage and/or search complexity.

A second type of codebooks are the algebraic codebooks. By contrast with the stochastic codebooks, algebraic codebooks are not random and require no substantial storage. An algebraic codebook is a set of indexed codevectors of which the amplitudes and positions of the pulses of the $k^{th}$ codevector can be derived from a corresponding index k through a rule requiring no, or minimal, physical storage. Therefore, the size of algebraic codebooks is not limited by storage requirements. Algebraic codebooks can also be designed for efficient search.

OBJECTS OF THE INVENTION

An object of the present invention is therefore to provide a method and device for drastically reducing the complexity of the codebook search upon encoding a sound signal, these method and device being applicable to a large class of codebooks.

SUMMARY OF THE INVENTION

More particularly, in accordance with the present invention, there is provided a method of conducting a depth-first search in a codebook in view of encoding a sound signal, wherein:

the codebook comprises a set of codevectors $A_k$ each defining a plurality of different positions p and comprising N non-zero-amplitude pulses each assignable to predetermined valid positions p of the codevector;

the depth-first search involves a tree structure defining a number M of ordered levels, each level m being associated with a predetermined number $N_m$ of at least one non-zero-amplitude pulse, wherein the sum of the predetermined numbers associated with all the M levels is equal to the number N of the non-zero-amplitude pulses comprised in the codevectors, each level m of the tree structure being further associated with a path building operation, with a given pulse-order rule and with a given selection criterion;

the depth-first codebook search conducting method comprising the steps of:

- in a level 1 of the tree structure, the association path-building operation consists of:
  - choosing $N_1$ of the N non-zero-amplitude pulses in relation to the associated pulse-order rule;
  - selecting at least one of the valid positions p of the $N_1$ non-zero-amplitude pulses in relation to the associated selection criterion to define at least one level-1 candidate path;
- in a level m of the tree structure, the associated path-building operation defines recursively a level-m candidate path by extending a level-(m−1) candidate path through the following substeps:
  - choosing $N_m$ of the non-zero-amplitude pulses not previously chosen in the course of building the level-(m−1) path in relation to the associated pulse-order rule;
  - selecting at least one of the valid positions p of the $N_m$ non-zero-amplitude pulse in relation to the associated selection criterion to form at least one level-m candidate path;
- wherein a level-M candidate path originated at a level-1 and extended during the path-building operations associated with subsequent levels of the tree structure determines the respective positions p of the N non-zero-amplitude pulses of a codevector and thereby defines a candidate codevector $A_k$.

The present invention also relates to a device for conducting a depth-first search in a codebook in view of encoding a sound signal, wherein:

the codebook comprises a set of codevectors $A_k$ each defining a plurality of different positions p and comprising N non-zero-amplitude pulses each assignable to predetermined valid positions p of the codevector;

the depth-first search involves (a) a partition of the N non-zero-amplitude pulses into a number M of subsets each comprising at least one non-zero-amplitude pulse, and (b) a tree structure including nodes representative of the valid positions p of the N non-zero-amplitude pulses and defining a plurality of search levels each associated to one of the M subsets, each search level being further associated to a given pulse-ordering rule and to a given selection criterion;

the depth-first codebook search conducting device comprising:

for a first search level of the tree structure, first means for choosing at least one of the N non-zero-amplitude pulses in relation to the associated pulse-ordering rule to form the associated subset;

first means for selecting at least one of the valid positions p of the at least one non-zero-amplitude pulse in relation to the associated selection criterion to define at least one path through the nodes of the tree structure;

for each subsequent search level of the tree structure, second means for choosing at least one of the non-zero-amplitude pulses not previously chosen in relation to the associated pulse-ordering function to form the associated subset; and second means for selecting, in the subsequent search level, at least one of the valid positions p of the at least one non-zero-amplitude pulse of the associated subset in relation to the associated selection criterion to extend the at least one path through the nodes of the tree structure; wherein each path defined at the first search level and extended during the subsequent search levels determines the respective positions p of the N non-zero-amplitude pulses of a codevector $A_k$ constituting a candidate codevector in view of encoding the sound signal.

The subject invention further relates to a cellular communication system for servicing a large geographical area divided into a plurality of cells, comprising:

mobile transmitter/receiver units;

cellular base stations respectively situated in the cells;

means for controlling communication between the cellular base stations;

a bidirectional wireless communication sub-system between each mobile unit situated in one cell and the cellular base station of the one cell, the bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises a device for conducting a depth-first search in a codebook in view of encoding a sound signal, wherein:

the codebook comprises a set of codevectors $A_k$ each defining a plurality of different positions p and comprising N non-zero-amplitude pulses each assignable to predetermined valid positions p of the codevector;

the depth-first search involves (a) a partition of the N non-zero-amplitude pulses into a number M of subsets each comprising at least one non-zero-amplitude pulse, and (b) a tree structure including nodes representative of the valid positions p of the N non-zero-amplitude pulses and defining a plurality of search levels each associated to one of the M subsets, each search level being further associated to a given pulse-ordering rule and to a given selection criterion;

the depth-first codebook search conducting device comprising:

for a first search level of the tree structure, first means for choosing at least one of the N non-zero-amplitude pulses in relation to the associated pulse-ordering rule to form the associated subset;

first means for selecting at least one of the valid positions p of the at least one non-zero-amplitude pulse in relation to the associated selection criterion to define at least one path through the nodes of the tree structure;

for each subsequent search level of the tree structure, second means for choosing at least one of the non-zero-amplitude pulses not previously chosen in relation to the associated pulse-ordering function to form the associated subset; and second means for selecting, in the subsequent search level, at least one of the valid positions p of the at least one non-zero-amplitude pulse of the associated subset in relation to the associated selection criterion to extend the at least one path through the nodes of the tree structure;

wherein each path defined at the first search level and extended during the subsequent search levels determines the respective positions p of the N non-zero-amplitude pulses of a codevector $A_k$ constituting a candidate codevector in view of encoding the sound signal.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

In the appended drawings:

FIG. 1 is a schematic block diagram of a preferred embodiment of an encoding system in accordance with the present invention, comprising a pulse-position likelihood-estimator and an optimizing controller;

FIG. 2 is a schematic block diagram of a decoding system associated to the encoding system of FIG. 1;

FIG. 3 is a schematic representation of a plurality of nested loops used by the optimizing controller of the encoding system of FIG. 1 for computing optimum codevectors;

DETAILED DESCRIPTION OF THE PREFERRED EMBODIMENTS

Although application of the depth-first codebook searching method and device according to the invention to a cellular communication system is disclosed as a non limitative example in the present specification, it should be kept in mind that these method and device can be used with the same advantages in many other types of communication systems in which sound signal encoding is required.

Figure 7:
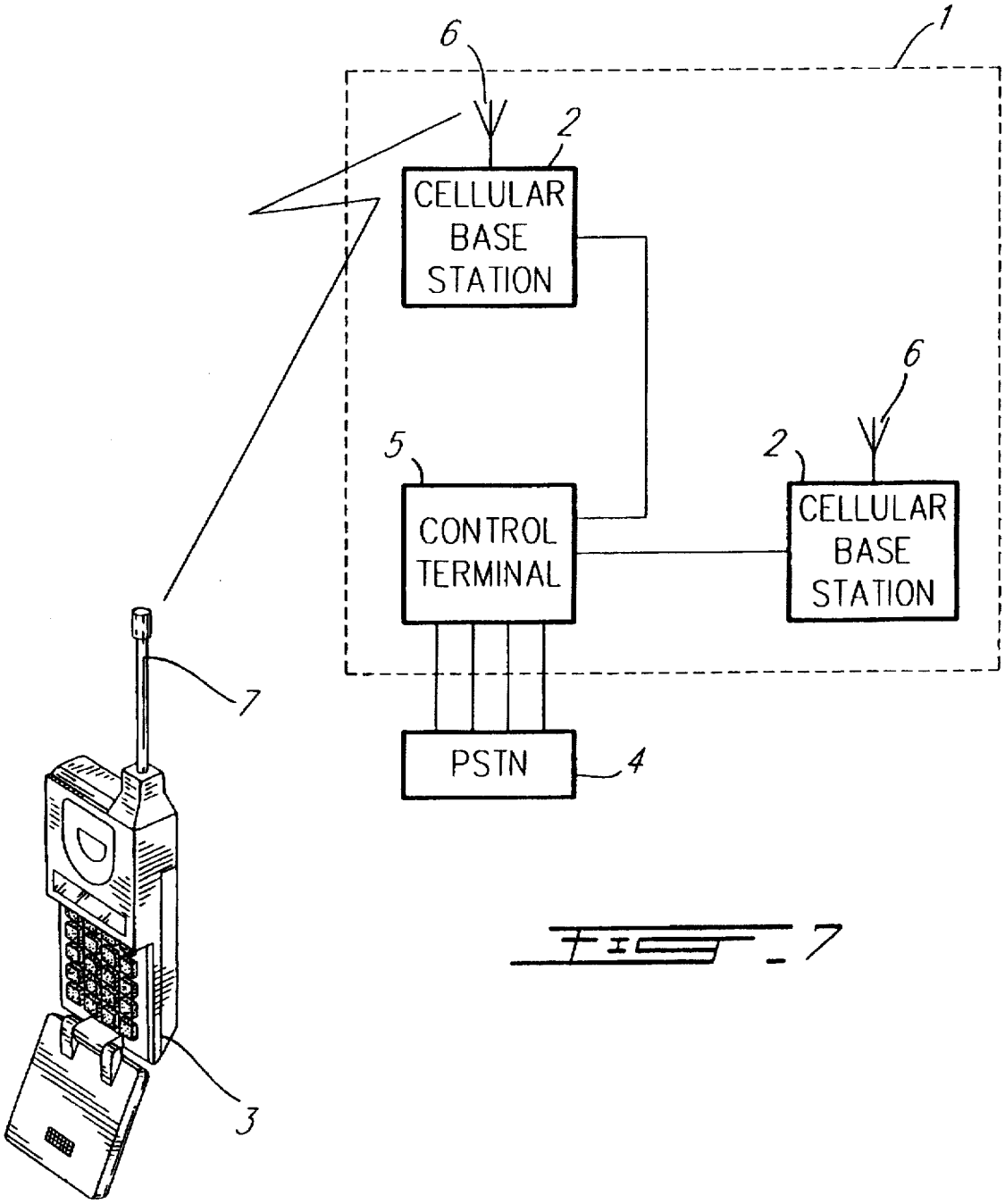
FIG. 7 is a schematic block diagram illustrating the infrastructure of a typical cellular communication system.

In a cellular communication system such as 1 (FIG. 7), a telecommunications service is provided over a large geographic area by dividing that large area into a number of smaller cells. Each cell has a cellular base station 2 for providing radio signalling channels, and audio and data channels.

The radio signalling channels are utilized to page mobile radio telephones (mobile transmitter/receiver units) such as 3 within the limits of the cellular base station's coverage area (cell), and to place calls to other radio telephones 3 either inside or outside the base station's cell, or onto another network such as the Public Switched Telephone Network (PSTN) 4.

Once a radio telephone 3 has successfully placed or received a call, an audio or data channel is set up with the cellular base station 2 corresponding to the cell in which the radio telephone 3 is situated, and communication between the base station 2 and radio telephone 3 occurs over that audio or data channel. The radio telephone 3 may also receive control or timing information over the signalling channel whilst a call is in progress.

If a radio telephone 3 leaves a cell during a call and enters another cell, the radio telephone hands over the call to an available audio or data channel in the new cell. Similarly, if no call is in progress a control message is sent over the signalling channel such that the radio telephone 3 logs onto the base station 2 associated with the new cell. In this manner mobile communication over a wide geographical area is possible.

The cellular communication system 1 further comprises a terminal 5 to control communication between the cellular base stations 2 and the PSTN 4, for example during a communication between a radio telephone 3 and the PSTN 4, or between a radio telephone 3 in a first cell and a radio telephone 3 in a second cell.

Of course, a bidirectional wireless radio communication sub-system is required to establish communication between each radio telephone 3 situated in one cell and the cellular base station 2 of that cell. Such a bidirectional wireless radio communication system typically comprises in both the radio telephone 3 and the cellular base station 2 (a) a transmitter for encoding the speech signal and for transmitting the encoded speech signal through an antenna such as 6 or 7, and (b) a receiver for receiving a transmitted encoded speech signal through the same antenna 6 or 7 and for decoding the received encoded speech signal. As well known to those of ordinary skill in the art, voice encoding is required in order to reduce the bandwidth necessary to transmit speech across the bidirectional wireless radio communication system, i.e. between a radio telephone 3 and a base station 2.

The aim of the present invention is to provide an efficient digital speech encoding technique with a good subjective quality/bit rate tradeoff for example for bidirectional transmission of speech signals between a cellular base station 2 and a radio telephone 3 through an audio or data channel. FIG. 1 is a schematic block diagram of a digital speech encoding device suitable for carrying out this efficient technique.

The speech encoding system of FIG. 1 is the same encoding device as illustrated in FIG. 1 of U.S. parent patent application Ser. No. 07/927,528 to which a pulse position estimator 112 in accordance with the present invention has been added. U.S. parent patent application Ser. No. 07/927,528 was filed on Sep. 10, 1992 for an invention entitled "DYNAMIC CODEBOOK FOR EFFICIENT SPEECH CODING BASED ON ALGEBRAIC CODES".

The analog input speech signal is sampled and block processed. It should be understood that the present invention is not limited to an application to speech signal. Encoding of other types of sound signal can also be contemplated.

In the illustrated example, the block of input sample speech S (FIG. 1) comprises L consecutive samples. In the CELP literature, L is designated as the "subframe" length and is typically situated between 20 and 80. Also, the blocks of L-samples are referred to as L-dimensional vectors. Various L-dimensional vectors are produced in the course of the encoding procedure. A list of these vectors which appear on FIGS. 1 and 2, as well as a list of transmitted parameters is given hereinbelow:

List of the main L-dimensional vectors:

S Input speech vector;

R' Pitch-removed residual vector;

X Target vector;

D Backward-filtered target vector;

$A_k$ Codevector of index k from the algebraic codebook; and $C_k$ Innovation vector (filtered codevector).

List of transmitted parameters:

k Codevector index (input of the algebraic codebook);

g Gain;

STP Short term prediction parameters (defining A(z)); and

LTP Long term prediction parameters (defining a pitch gain b and a pitch delay T).

Decoding Principle

It is believed preferable to describe first the speech decoding device of FIG. 2 illustrating the various steps carried out between the digital input (input of demultiplexer 205) and the output sampled speech (output of synthesis filter 204).

The demultiplexer 205 extracts four different parameters from the binary information received from a digital input channel, namely the index k, the gain g, the short term prediction parameters STP, and the long term prediction parameters LTP. The current L-dimensional vector S of speech signal is synthesized on the basis of these four parameters as will be explained in the following description.

The speech decoding device of FIG. 2 comprises a dynamic codebook 208 composed of an algebraic code generator 201 and an adaptive prefilter 202, an amplifier 206, an adder 207, a long term predictor 203, and a synthesis filter 204.

In a first step, the algebraic code generator 201 produces a codevector $A_k$ in response to the index k.

In a second step, the codevector $A_k$ is processed through an adaptive prefilter 202 supplied with the long term prediction parameters LTP to produce an output innovation vector $C_k$. The purpose of the adaptive prefilter 202 is to dynamically control the frequency content of the output innovation vector $C_k$ so as to enhance speech quality, i.e. to reduce the audible distortion caused by frequencies annoying the human ear. Typical transfer functions F(z) for the adaptive prefilter 202 are given below:

$$F_a(z)=\left(\frac{A(z/\gamma_1)}{A(z/\gamma_2)}\right)$$

$$F_b(z)=\frac{1}{(1-b_0z^T)}$$

$F_a(z)$ is a formant prefilter in which $0<\gamma_1<\gamma_2<1$ are constants. This prefilter enhances the formant regions and works very effectively especially at coding rate below 5 kbit/s.

$F_b(z)$ is a pitch prefilter where T is the time varying pitch delay and $b_0$ is either constant or equal to the quantized long term pitch prediction parameter from the current or previous subframes. $F_b(z)$ is very effective to enhance pitch harmonic frequencies at all rates. Therefore, F(z) typically includes a pitch prefilter sometimes combined with a formant prefilter, namely, $F(z)=F_a(z)F_b(z)$. Other forms of prefilter can also be applied profitably.

In accordance with the CELP technique, the output sampled speech signal $\hat{S}$ is obtained by first scaling the innovation vector $C_k$ from the codebook 208 by the gain g through the amplifier 206. The adder 207 then adds the scaled waveform $gC_k$ to the output E (the long term prediction component of the signal excitation of the synthesis filter 204) of a long term predictor 203 supplied with the LTP parameters, placed in a feedback loop and having a transfer function B(z) defined as follows:

$$B(z)=bz^{-T}$$

where b and T are the above defined pitch gain and delay, respectively.

The predictor 203 is a filter having a transfer function in accordance to the last received LTP parameters b and T to model the pitch periodicity of speech. It introduces the appropriate pitch gain b and delay T of samples. The composite signal $E+gC_k$ constitutes the signal excitation of the synthesis filter 204 which has a transfer function 1/A(z). The filter 204 provides the correct spectrum shaping in accordance with the last received STP parameters. More specifically, the filter 204 models the resonant frequencies (formants) of speech. The output block $\hat{S}$ is the synthesized sampled speech signal which can be converted into an analog signal with proper anti-aliasing filtering in accordance with a technique well known in the art.

There are many ways to design an algebraic codebook 208. In the present invention, the algebraic codebook 208 is composed of codevectors having N non-zero-amplitude pulses (or non-zero pulses for short).

Let us call $P_i$ and $S_{pi}$ the position and amplitude of the $i^{th}$ non-zero pulse, respectively. We will assume that the amplitude $S_{pi}$ is known either because the $i^{th}$ amplitude is fixed or because there exists some method for selecting $S_{pi}$ prior to the codevector search.

Let us call "track i", denoted $T_i$ the set of positions that $P_i$ can occupy between 1 and L. Some typical sets of tracks are given below assuming L=40. The first example is a design introduced in the above mentioned U.S. patent application Ser. No. 927,528 and referred to as "Interleaved Single Pulse Permutations" (ISPP). In the first design example, denoted ISPP(40,5), a set of 40 positions is partitioned in 5 interleaved tracks of 40/5=8 valid positions each. Three bits are required to specify the $8=2^3$ valid positions of a given pulse. Therefore, a total of 5×3=15 coding bits are required to specify pulse positions for this particular algebraic codebook structure.

| Design 1: ISPP(40,5) | |
|---|---|
| i | Tracks (valid positions for the $i^{th}$ pulse) |
| 1 | T1 = {1, 6, 11, 16, 21, 26, 31, 36} |
| 2 | T2 = {2, 7, 12, 17, 22, 27, 32, 37} |
| 3 | T3 = {3, 8, 13, 18, 23, 28, 33, 38} |
| 4 | T4 = {4, 9, 14, 19, 24, 29, 34, 39} |
| 5 | T5 = {5, 10, 15, 20, 25, 30, 35, 40} |

This ISPP is complete in the sense that any of the 40 positions is related to one and only one track. There are many ways to derive a codebook structure from one, or more, ISPP to accommodate particular requirements in terms of number of pulses or coding bits. For instance, a four-pulse codebook can be derived from ISPP(40,5) by simply ignoring track 5, or by considering the union of tracks 4 and 5 as a single track. Design examples 2 and 3 provide other instances of complete ISPP designs.

| i | Tracks (valid positions for the $i^{th}$ pulse) |
|---|---|
| Design 2: ISPP(40,10) | |
| 1 | T1 = {1, 11, 21, 31} |
| 2 | T2 = {2, 12, 22, 32} |
| 3 | T3 = {3, 13, 23, 33} |
| . . . | . . . |
| 9 | T9 = {9, 19, 29, 39} |
| 10 | T10 = {10, 20, 30, 40} |
| Design 3: ISPP(48,12) | |
| 1 | T1 = {1, 13, 25, 37} |
| 2 | T2 = {2, 14, 26, 38} |
| 3 | T3 = {3, 15, 27, 39} |
| 4 | T4 = {4, 16, 28, 40} |
| 5 | T5 = {5, 17, 29, 41} |
| . . . | . . . |
| 11 | T9 = {11, 23, 35, 47} |
| 12 | T10 = {12, 24, 36, 48} |

Note that in design 3, the last pulse position of tracks T5 through T12 fall outside the subframe length L=40. In such a case the last pulse is simply ignored.

| Design 4: Sum of two ISPP(40,1) | |
|---|---|
| i | Tracks (valid positions for the $i^{th}$ pulse) |
| 1 | T1 = {1, 2, 3, 4, 5, 6, 7, . . . , 39, 40} |
| 2 | T2 = {1, 2, 3, 4, 5, 6, 7, . . . , 39, 40} |

In design example 4, tracks T1 and T2 allow for any of the 40 positions. Note that the positions of tracks T1 and T2 overlap. When more than one pulse occupy the same location their amplitudes are simply added together.

A great variety of codebooks can be built around the general theme of ISPP designs.

Encoding Principle

The sampled speech signal S is encoded on a block by block basis by the encoding system of FIG. 1 which is broken down into 11 modules numbered from 102 to 112. The function and operation of most of these modules are unchanged with respect to the description of U.S. parent patent application Ser. No. 07/927,528. Therefore, although the following description will at least briefly explain the function and operation of each module, it will focus on the matter which is new with respect to the disclosure of U.S. parent patent application Ser. No. 07/927,528.

For each block of L samples of speech signal, a set of Linear Predictive Coding (LPC) parameters, called short term prediction (STP) parameters, is produced in accordance with a prior art technique through an LPC spectrum analyzer 102. More specifically, the analyzer 102 models the spectral characteristics of each block S of L samples.

The input block S of L-sample is whitened by a whitening filter 103 having the following transfer function based on the current values of the STP parameters:

$$A(z)=\sum_{i=0}^{M} a_i z^{-i}$$

where $a_0=1$, and z is the usual variable of the so-called z-transform. As illustrated in FIG. 1, the whitening filter 103 produces a residual vector R.

A pitch extractor 104 is used to compute and quantize the LTP parameters, namely the pitch delay T and the pitch gain g. The initial state of the extractor 104 is also set to a value FS from an initial state extractor 110. A detailed procedure for computing and quantizing the LTP parameters is described in U.S. parent patent application Ser. No. 07/927,528 and is believed to be well known to those of ordinary skill in the art. Accordingly, it will not be further elaborated in the present disclosure.

A filter responses characterizer 105 (FIG. 1) is supplied with the STP and LTP parameters to compute a filter responses characterization FRC for use in the later steps. The FRC information consists of the following three components where n=1, 2, . . . L.

f (n): response of F(z).

Note that F (z) generally includes the pitch prefilter.

h(n): response of $$\frac{1}{A(z\gamma^{-1})}$$

to f(n) where γ is a perceptual factor.

More generally, h(n) is the impulse response of F(z)W (z)/A(z) which is the cascade of prefilter F(z), perceptual weighting filter W(z) and synthesis filter 1/A(Z). Note that F(z) and 1/A(z) are the same filters as used at the decoder.

U(i,j): autocorrelation of h(n) according to the following expression:

$$U(i,j)=\sum_{k=1}^{L} h(k-i+1)h(k-j+1);$$

for $1\leqq i\leqq L$ and $i\leqq j\leqq L$; h(n)=1 for n<1.

The long term predictor 106 is supplied with the past excitation signal (i.e., E+gCk of the previous subframe) to form the new E component using the proper pitch delay T and gain b.

The initial state of the perceptual filter 107 is set to the value FS supplied from the initial state extractor 110. The pitch removed residual vector R'=R−E calculated by a subtractor 121 (FIG. 1) is then supplied to the perceptual filter 107 to obtain at the output of the latter filter a target vector X. As illustrated in FIG. 1, the STP parameters are applied to the filter 107 to vary its transfer function in relation to these parameters. Basically, X=R'−P where P represents the contribution of the long term prediction (LTP) including "ringing" from the past excitations. The MSE criterion which applies to A can now be stated in the following matrix notations:

$$\begin{aligned}\min_k\|\Delta\|^2 &= \min_k\|S'-\hat{S}'\|^2=\min_k\|S'-[P-gA_kH^T]\|^2\\ &= \min_k\|X-gA_kH^T\|^2\end{aligned}$$

where H is an L×L lower triangular Toeplitz matrix formed from the h(n) response as follows. The term h(0) occupies the matrix diagonal and h(1), h(2), . . . and h(L−1) occupy the respective lower diagonals.

A backward filtering step is performed by the filter 108 of FIG. 1. Setting to zero the derivative of the above equation with respect to the gain g yields to the optimum gain as follows:

$$\frac{\partial\|\Delta\|^2}{\partial g}=0$$

$$g=\frac{X(A_kH^T)^T}{\|A_kH^T\|^2}$$

With this value for g, the minimization becomes:

$$\min_k\|\Delta\|^2=\min_k\left\{\|X\|^2-\frac{(X(A_kH^T)^T)^2}{\|A_kH^T\|^2}\right\}$$

The objective is to find the particular index k for which the minimization is achieved. Note that because $\|X\|^2$ is a fixed quantity, the same index can be found by maximizing the following quantity:

$$\max_k\frac{(X(A_kH^T)^T)^2}{\|A_kH^T\|^2}=\max_k\frac{((XH)A_k^T)^2}{\alpha^2 k}=\max_k\frac{(DA_k^T)^2}{\alpha^{2k}}$$

where D=(XH) and $\alpha_k^2=\|A_kH^T\|^2$.

In the backward filter 108, a backward filtered target vector D=(XH) is computed. The term "backward filtering" for this operation comes from the interpretation of (XH) as the filtering of time-reversed X.

The purpose of the optimizing controller 109 is to search the codevectors available in the algebraic codebook to select the best codevector for encoding the current L-sample block. The basic criterion for selecting the best codevector among a set of codevectors each having N non-zero-amplitude pulses is given in the form of a ratio to be maximized:

$$\text{Basic Selection Criterion: } k=\max_k{}^{-1}\,[Q_k(N)]$$

where $$Q_k(N)=\left[\frac{(DA_k^T)^2}{\alpha_k^2}\right]$$

and where $A_k$ has N non-zero amplitude pulses. The numerator in the above equation is the square of $$DA_k^T=\Sigma D_{Pi}S_{Pi}$$

where D is the backward-filtered target vector and $A_k$ is the algebraic codevector having N non zero pulses of amplitudes $S_{pi}$.

The denominator is an energy term which can be expressed $$\alpha_k^2 = \sum_{i=1}^{N} S_{p_i}^2 U(p_i,p_i) + 2\sum_{i=1}^{N-1}\sum_{j=i+1}^{N} S_{p_i}S_{p_j}U(p_i,p_j)$$

where $U(p_i,p_j)$ is the correlation associated with two unit-amplitude pulses, one at location $p_i$ and the other at location $p_j$. This matrix is computed in accordance with the above equation in the filter response characterizer module 105 and included in the set of parameters referred to as FRC in the block diagram of FIG. 1.

A fast method for computing this denominator involves the N-nested loops illustrated in FIG. 4 in which the trim lined notation S(i) and SS(i,j) is used in the place of the respective quantities "$S_{pi}$" and "$S_{pi}S_{pj}$". Computation of the denominator $\alpha_k^2$ is the most time consuming process. The computations contributing to $\alpha_k^2$ which are performed in each loop of FIG. 4 can be written on separate lines from the outermost loop to the innermost loop as follows:

$$\begin{aligned}\alpha_k^2 = {} & S_{p_1}^2 U(p_1,p_1) + \\ & S_{p_2}^2 U(p_2,p_2) + 2S_{p_1}S_{p_2}U(p_1,p_2) + \\ & S_{p_3}^2 U(p_3,p_3) + 2[S_{p_1}S_{p_3}U(p_1,p_3) + S_{p_2}S_{p_3}U(p_2,p_3)] + \\ & \ldots \quad \ldots \quad \ldots \quad \ldots \\ & S_{p_N}^2 U(p_N,p_N) + 2[S_{p_1}S_{p_N}U(p_1,p_N) + S_{p_2}S_{p_N}U(p_2,p_N) + \ldots + \\ & S_{p_{N-1}}S_{p_N}U(p_{N-1},p_N)]\end{aligned}$$

where $p_i$ is the position of the $i^{th}$ non-zero pulse.

The previous equation can be simplified if some pre-computing is performed by the optimizing controller 109 to transform the matrix U(i,j) supplied by the filter response characterizer 105 into a matrix U'(i,j) in accordance with the following relation:

$$U'(j,k)=S_j\, S_k\, U(j,k)$$

where $S_k$ is the amplitude selected for an individual pulse at position k following quantization of the corresponding amplitude estimate (to be described in the following description). The factor 2 will be ignored in the rest of the discussion in order to streamline the equations.

With the new matrix U'(j,k), the computation (see FIG. 3) for each loop of the fast algorithm can be written on a separate line, from outermost to innermost loops, as follows:

$$\begin{aligned}\alpha_k^2 = {} & U'(p_1,p_1) + \\ & U'(p_2,p_2) + U'(p_1,p_2) + \\ & U'(p_3,p_3) + U'(p_1,p_3) + U'(p_2,p_3) + \\ & \ldots \quad \ldots \quad \ldots \quad \ldots \\ & U'(p_N,p_N) + U'(p_1,p_N) + U'(p_2,p_N) + \ldots + U'(p_{N-1},p_N)\end{aligned}$$

Figure 4A:
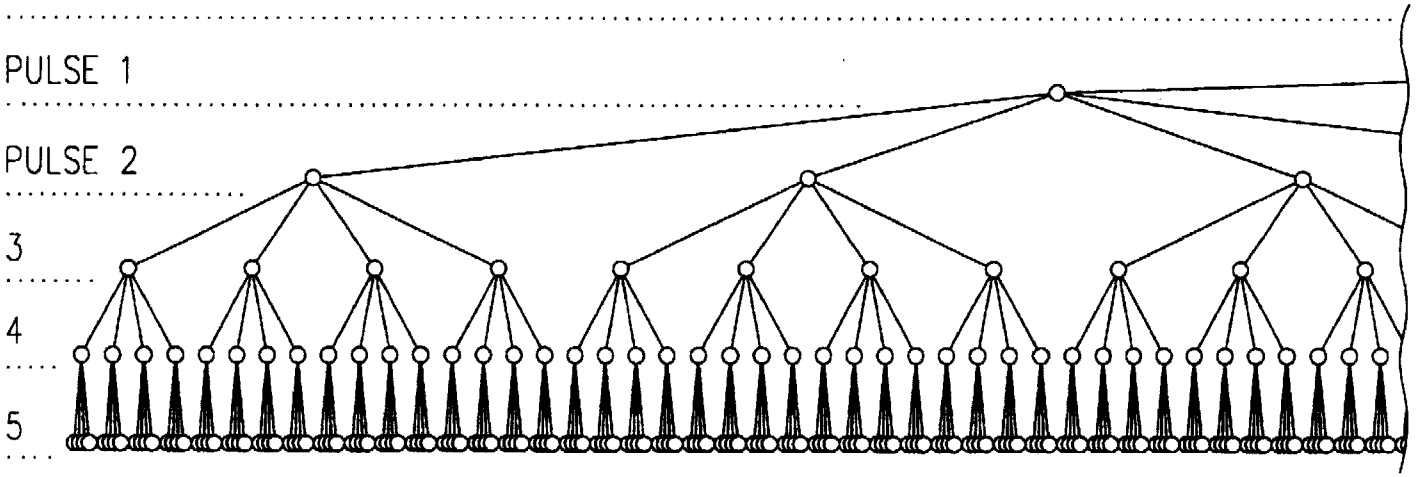
FIG. 4*a* shows a tree structure to illustrate by way of an example some features of the "nested-loop search" technique of FIG. 3.
Figure 4B:
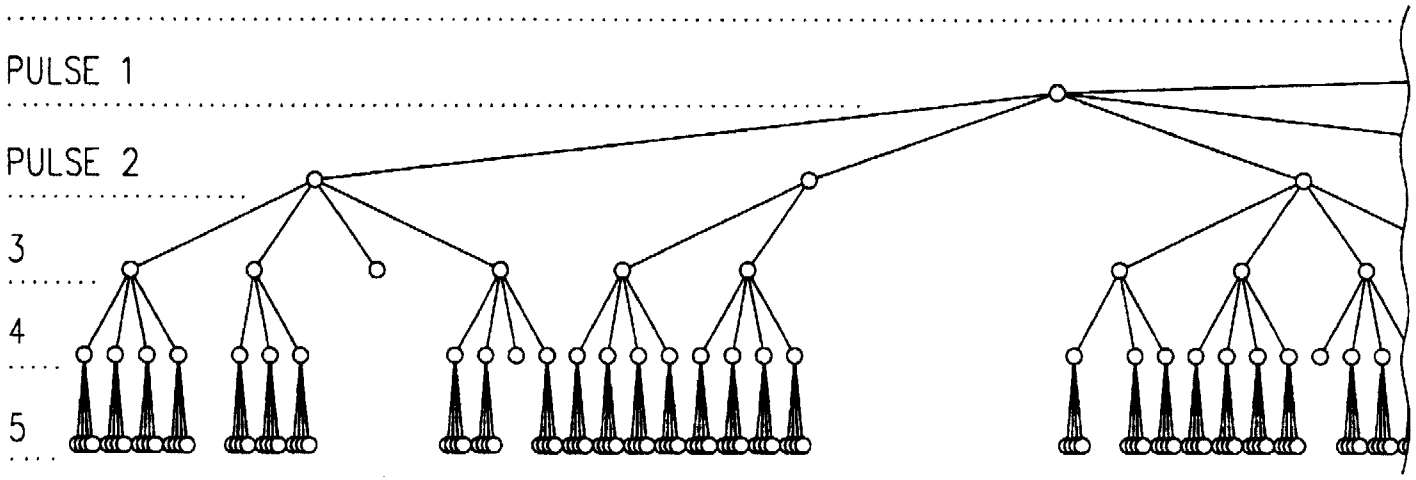
FIG. 4*b* shows the tree structure of FIG. 4*a* when the processing at lower levels is conditioned on the performance exceeding some given threshold; this is a faster method of exploring the tree by focusing only on the most promising regions of that tree.
Figure 5:
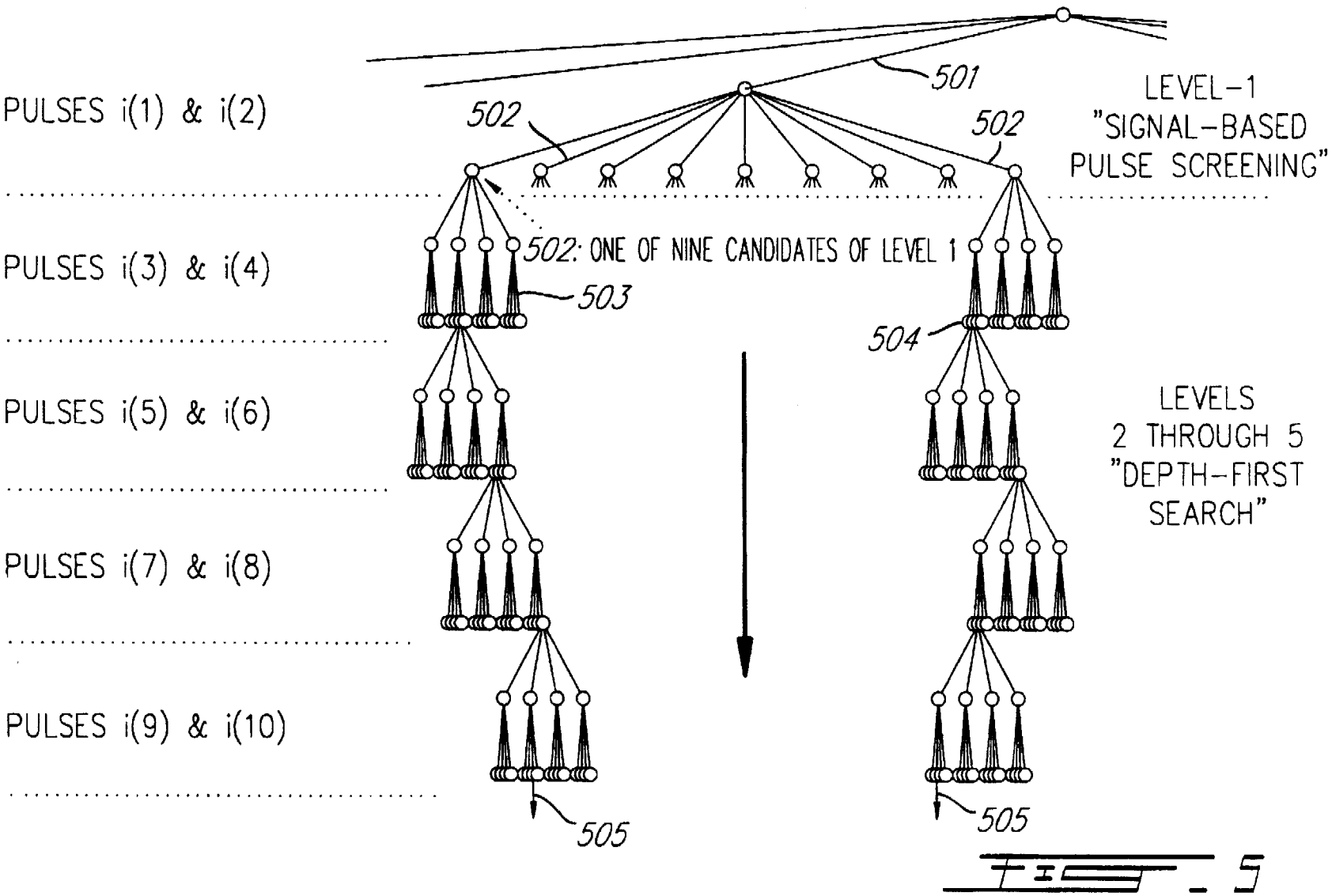

FIGS. 4*a* and 4*b* shows two examples of a tree structure to illustrate some features of the "nested-loop search" technique just described and illustrated in FIG. 3, in order to contrast it with the present invention. The terminal nodes at the bottom of the tree of FIG. 4*a* illustrate all possible combinations of pulse positions for a five-pulse example (N=5) wherein each pulse can assume one of four possible positions. The exhaustive "nested-loop search" technique proceeds through the tree nodes basically from left to right as indicated. One drawback of the "nested-loop search" approach is that the search complexity increases as a function of the number of pulses N. To be able to process codebooks having a larger number N of pulses, one must settle for a partial search of the codebook. FIG. 4*b* illustrates the same tree wherein a faster search is achieved by focusing only on the most promising region of the tree. More precisely, proceeding to lower levels is not systematic but conditioned on performance exceeding some given thresholds.

Depth-First Search

Let's now turn our attention to the alternate faster technique constituting the object of the present invention and performed by the pulse-position likelihood-estimator 112 and the optimizing controller 109 of FIG. 1. The general features of this technique will be first described. Thereafter, a number of typical illustrative embodiments of the faster technique will be described.

The goal of the search is to determine the codevector with the best set of N pulse positions assuming amplitudes of the pulses are either fixed or have been selected by some signal-based mechanism prior to the search such as described in co-pending U.S. patent application Ser. No. 08/383,968 filed on Feb. 6, 1995. The basic selection criterion is the maximization of the above mentioned ratio $Q_k$.

In order to reduce the search complexity, the pulses positions are determined $N_M$ pulses at a time. More precisely, the N available pulses are partitioned (step 601 of FIG. 6) into M non-empty subsets of $N_m$ pulses respectively such that $N_1+N_2 \ldots +N_m \ldots +N_M=N$. A particular choice of positions for the first $J=N_1+N_2 \ldots +N_{m-1}$ pulses considered is called a level-m path or a path of length J. The basic criterion for a path of J pulse positions is the ratio $Q_k(J)$ when only the J relevant pulses are considered.

The search begins with subset #1 and proceeds with subsequent subsets according to a tree structure whereby subset m is searched at the $m^{th}$ level of the tree.

The purpose of the search at level 1 is to consider the $N_1$ pulses of subset #1 and their valid positions in order to determine one, or a number of, candidate path(s) of length $N_1$ which are the tree nodes at level 1.

The path at each terminating node of level m−1 is extended to length $N_1+N_2 \ldots +N_m$ at level m by considering $N_m$ new pulses and their valid positions. One, or a number of, candidate extended path(s) are determined to constitute level-m nodes.

The best codevector corresponds to that path of length N which maximizes the criterion $Q_k(N)$ with respect to all level-M nodes.

Whereas, in the above mentioned U.S. patent application Ser. No. 927,528, the pulses (or tracks) are explored in a pre-established order (i=1,2, . . . N) they are considered in various orders in the present invention. In fact, they can be considered according to which order is deemed the most promising under the particular circumstances at any one time during the search. To this end, a new chronological index n (n=1, 2, . . . N) is used and the ID(identification)-number of the $n^{th}$ pulse considered in the search is given by the "pulse-order function": i=i(n). For instance at some particular time, the search path, for a 5-pulse codebook, might proceed according to the following pulse-order function:

| | | |
|---|---|---|
| n = | 1 2 3 4 5 | chronological index |
| i = | 4 3 1 5 2 | pulse (or track) ID |

In order to guess intelligently which pulse order is more promising at any one time, the present invention introduces a "pulse-position likelihood-estimate vector" B, which is based on speech-related signals. The $p^{th}$ component $B_p$ of this estimate vector B characterizes the probability of a pulse occupying position p (p=1, 2, . . . L) in the best codevector we are searching for. This best codevector is still unknown and it is the purpose of the present invention to disclose how some properties of this best codevector can be inferred from speech-related signals.

The estimate vector B can be used as follows.

Firstly, the estimate vector B serves as a basis to determine for which tracks i or j it is easier to guess the pulse position. The track for which the pulse position is easier to guess should be processed first. This property is often used in the pulse ordering rule for choosing the $N_m$ pulses at the first levels of the tree structure.

Secondly, for a given track, the estimate vector B indicates the relative probability of each valid position. This property is used advantageously as a selection criterion in the first few levels of the tree structure in place of the basic selection criterion $Q_k(j)$ which anyhow, in the first few levels operates on too few pulses to provide reliable performance in selecting valid positions.

The preferred method for obtaining the pulse-position likelihood-estimate vector B from speech-related signals consists of calculating the sum of the normalized backward-filtered target vector D:

$$(1-\beta)\frac{D}{\|D\|}$$

and the normalized pitch-removed residual signal R':

$$\beta\frac{R'}{\|R'\|}$$

to obtain the pulse-position likelihood-estimate vector B:

$$B=(1-\beta)\frac{D}{\|D\|}+\beta\frac{R'}{\|R'\|}$$

where β is a fixed constant with a typical value of ½ (β is chosen between 0 and 1 depending on the percentage of non-zero pulses used in the algebraic code).

It should be pointed out here that the same estimate vector B is used in a different context and for a different purpose in copending U.S. patent application Ser. No. 08/383,968 filed on Feb. 6, 1995 for an invention entitled "ALGEBRAIC CODEBOOK WITH SIGNAL-SELECTED PULSE AMPLITUDES FOR FAST CODING OF SPEECH", which discloses a method of selecting apriori a near-optimal combination of pulse amplitudes. This is useful in the context of an algebraic codebook design where non-zero pulse amplitudes may assume one of q values, where q>1. This observation confirms that the discovery of good estimators such as B which can be inferred from the signal itself is of deep significance to efficient speech coding. In actual fact, beyond being estimators for either positions or amplitudes they are estimators for the codevector $A_k$ itself. Therefore any search technique which combines both the principles of said copending U.S. patent application Ser. No. 08/383,968 and of the present application is clearly within the nature and spirit of the present invention. The following is an example of a typical combined technique within the spirit of the invention. It was pointed out earlier in the present disclosure that when two or more pulses from overlapping tracks share the same position in the frame they should be added. This position-amplitude tradeoff can be jointly optimized by a trellis-like search.

For convenience, both the constants and variables already defined are listed hereinbelow.

List of Constants

| Constant | Example | Name/meaning |
|---|---|---|
| L | 40 | Frame length (Number of positions); |
| N | 10 | Number of pulses; |
| $L_i$ | 4 | Number of possible positions in track i; |
| M | 5 | Number of levels; |
| $N_m$ | 2 | Number of pulses associated with level m; |
| $S_p$ | −1 | Amplitude at position p; |
| $p_i$ | 13 | Position of $i^{th}$ pulse; |
| $p_{i(n)}$ | 19 | Position of $n^{th}$ processed pulse. |

List of variables

| INDEX | RANGE | NORMAL USAGE |
|---|---|---|
| p | 1–L | Position index within frame; |
| i | 1–N | Pulse index; |
| m | 1–M | Subset index; |
| n | 1–N | Processing-order index; |
| i(n) | 1–N | Index of the $n^{th}$ processed pulse; |
| $p_{i(n)}$ | 1–L | Position of $n^{th}$ processed pulse; |
| $S_p$ | {±1} | Amplitude at position p; and |
| $Sp_{i(n)}$ | {±1} | Amplitude at position occupied by the $n^{th}$ pulse. |

Examples of Depth-First Searches

Let us now consider a number of typical examples of depth-first searches.

SEARCH TECHNIQUE #1
Algebraic Codebook

L = 40; N = 5
ISPP(40,5) (i.e.: $L_1 = L_2 = \ldots L_5 = 8$).

Search procedure:

| Level m | Number of pulses, $N_m$ | Candidate paths | Pulse-order rule | Selection Criterion |
|---|---|---|---|---|
| 1 | 1 | 10 | R1, R2 | B |
| 2 | 2 | 2 | R2 | $Q_k$ (2) |
| 3 | 2 | 2 | R2 | $Q_k$ (4) |

Rule R1:

The 10 ways to choose a first pulse position $P_{i(1)}$ for the level-1 path-building operation is to consider each of the 5 tracks in turn, and for each track select in turn one of the two positions that maximize $B_p$ for the track under consideration.

Rule R2:

Rule 2 defines the pulse-order function to be used for four pulses considered at levels 2 and 3 as follows. Lay out the four remaining indices on a circle and re-number them in a clockwise fashion starting at the right of the i(1) pulse (i.e., the pulse number of the particular level-1 node considered).

We now turn to a second instance of the depth-first codebook search called Search technique #2 which will clearly exemplify the depth first principle.

SEARCH TECHNIQUE #2
Algebraic Codebook

L = 40; N = 10
ISPP(40,10) (i.e.: $L_1 = L_2 = \ldots L_{10} = 4$)
Search procedure:

| level m | Number of pulses, $N_m$ | Candidate paths | Pulse-order rule | Selection Criterion |
|---|---|---|---|---|
| 1 | 2 | 9 | R3 | B |
| 2 | 2 | 1 | R4 | $Q_k$ (4) |
| 3 | 2 | 1 | R4 | $Q_k$ (6) |
| 4 | 2 | 1 | R4 | $Q_k$ (8) |
| 5 | 2 | 1 | R4 | $Q_k$ (10) |

Rule R3:

Choose pulse i(1) and select its position according to the maximum of $B_p$ over all p. For i(2), choose in turn each of the remaining 9 pulses. The selection criterion for a given i(2) consists of selecting the position which maximizes $B_p$ within its track.

Rule R4:

At the end of level 1. The entire pulse order function is determined by laying out the eight remaining indexes n on a circle and re-numbering them in a clockwise fashion starting at the right of i(2).

Figure 5:
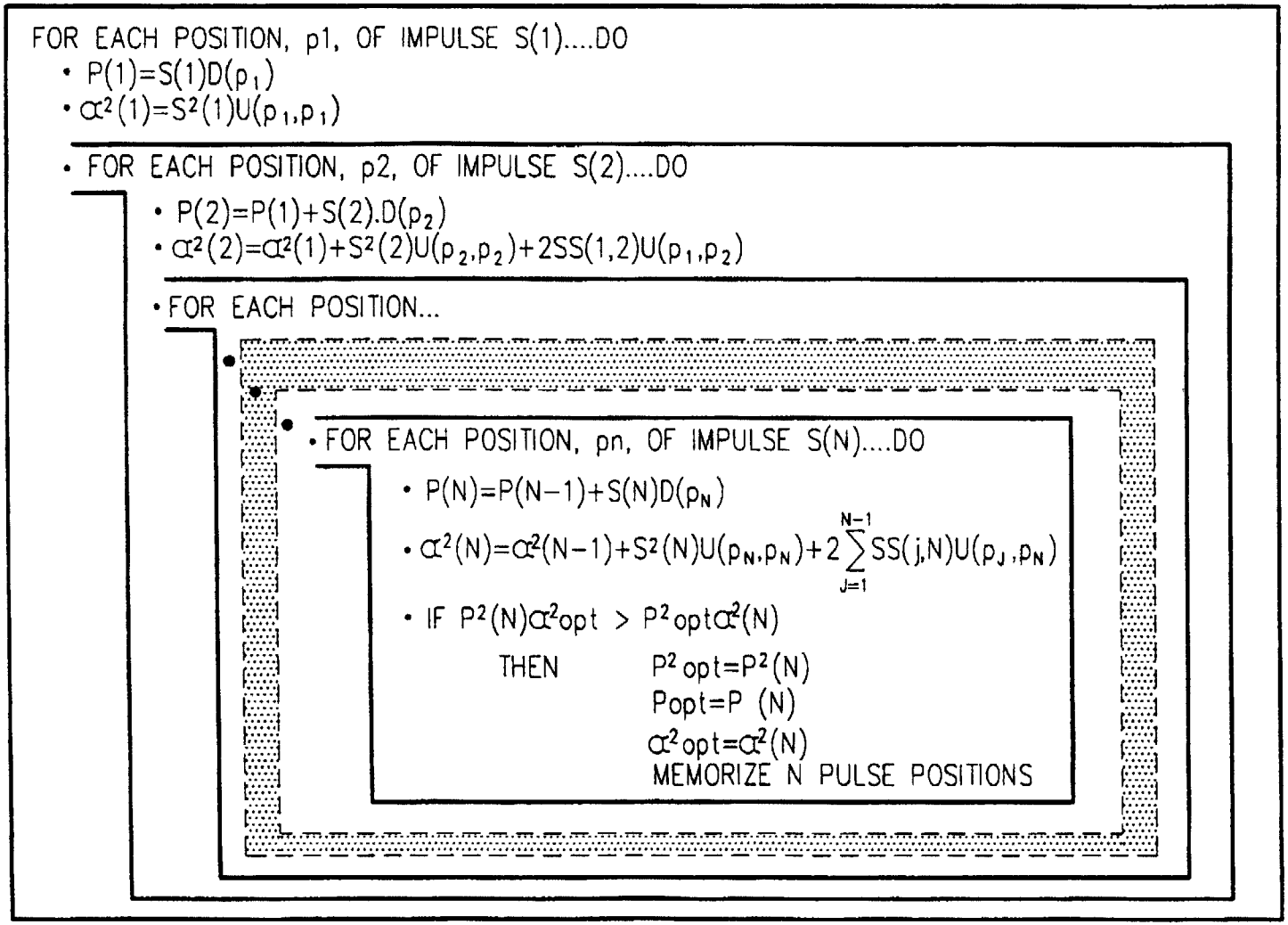
FIG. 5 illustrates how the depth-first search technique is proceeding through a tree structure to some combinations of pulse positions; the example relates to a ten-pulse codebook of forty-positions codevectors designed according to an interleaved single-pulse permutations.
Figure 6:
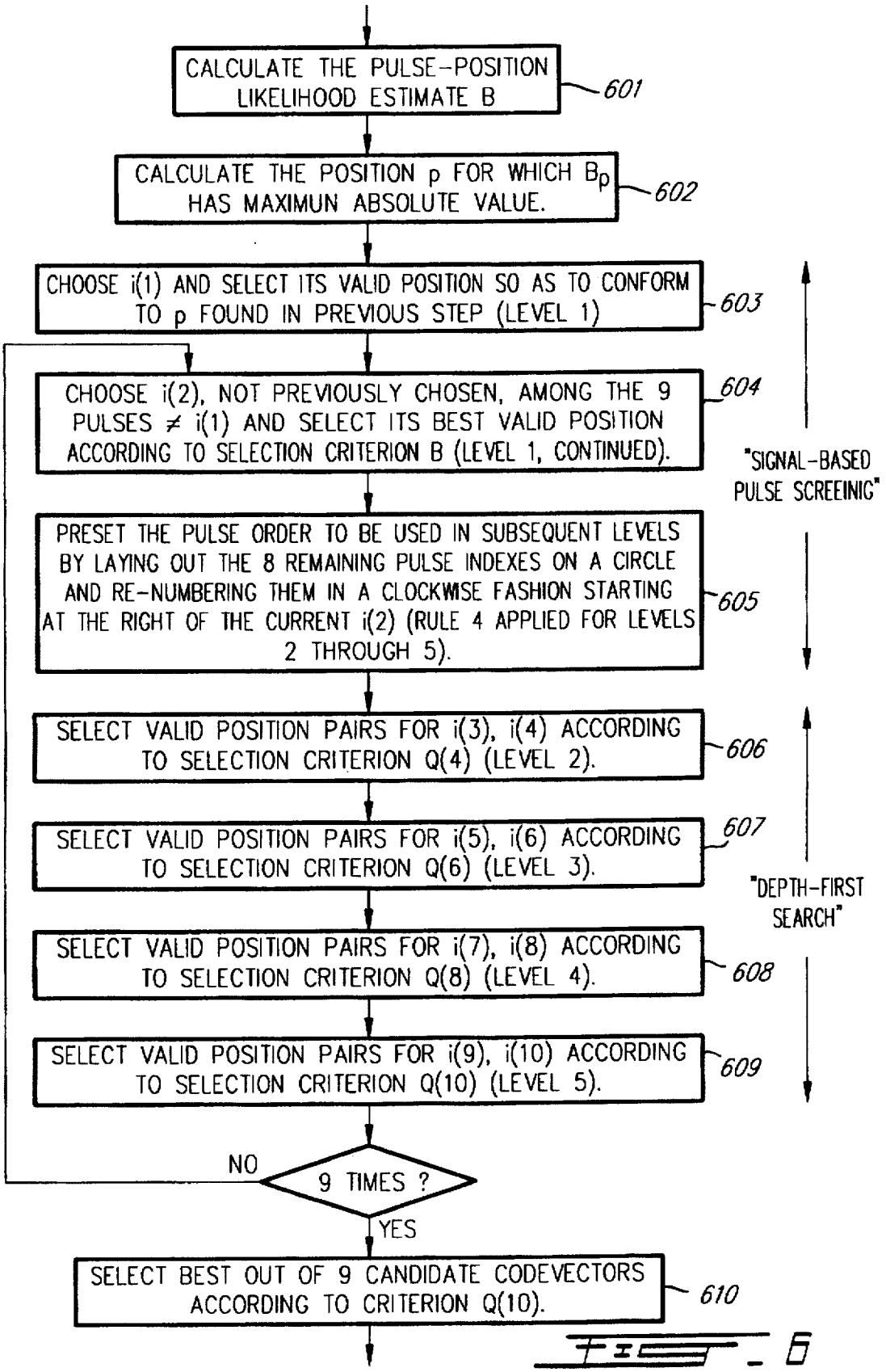
FIG. 6 is a schematic flow chart showing operation of the pulse-position likelihood-estimator and an optimizing controller of FIG. 1.

Search technique #2 is illustrated in FIGS. 5 and 6. FIG. 5 illustrates the tree structure of the depth-first search technique #2 applied to a 10 pulse codebook of 40 positions codevectors designed according to an interleaved single-pulse permutations. The corresponding flow chart is illustrated in FIG. 6.

The L=40 positions are partitioned into 10 tracks each associated to one of the N=10 non-zero-amplitude pulses of the codevectors. The ten tracks are interleaved in accordance with N interleaved single-pulse permutations.

Step 601

The above described pulse-position likelihood-estimate vector B is calculated.

Step 602

The position p of the maximum absolute value of the estimated $B_p$ is calculated.

Step 603 (start level-1 path building operations)

Choose pulse (i.e., track) i(1) and select ita valid position so that it conforms to the position found in step 602 (see 501 in FIG. 5).

Step 604 (end level-1 path-building operations)

For i(2), choose in turn each of the remaining 9 pulses. The selection criterion for a given i(2) consists of selecting the position which maximizes $B_p$ within the track of said given i(2). Thus, 9 distinct level-1 candidate paths are originated (see 502 in FIG. 5). Each of said level-1 candidate path is thereafter extended through subsequent levels of the tree structure to form 9 distinct candidate codevectors. Clearly, the purpose of level-1 is to pick nine good starting pairs of pulses based on the B estimate. For this reason, level-a path building operations are called "signal-based pulse screening" in FIG. 5.

Step 605 (Rule R4)

To save computation time, the pulse order to be used in the subsequent 4 levels is preset. Namely, the pulse order function i(n) for n=3, 4, . . . 10 is determined by laying out the eight remaining indexes n on a circle and re-numbering them in a clockwise fashion starting at the right of i(2). In accordance with this order, the pulses i(3) and i(4) are chosen for level-2, pulses i(5) and i(6) are already chosen for level-3, and so on.

Steps 606, 607, 608, 609, (Levels 2 through 5)

Levels 2 through 5 are designed for efficiency and follow identical procedures. Namely, an exhaustive search is applied to all sixteen combinations of the four positions of the two pulses considered (see 503 in FIG. 5) according to the associated selection criterion $Q_k(2m)$, where m=2, 3, 4, 5 is the level number.

Because only a single candidate path results from each path building operation(see 504 in FIG. 5) associated with levels 2 through 5 (i.e., branching factor of 1), the complexity of the search grows only essentially linearly with the total number of pulses. For this reason the search performed in levels 2 through 5 can be accurately characterized as a depth-first search. Tree search techniques varies greatly in structures, criteria and problem domains, however, in the field of artificial intelligence it is customary to contrast two broad classes of search philosophy, namely, "breadth-first searches" and "depth-first searches".

Step 610

The 9 distinct level-1 candidate paths originated in step 604 and extended through levels 2 through 5 (i.e., step 605 through 609) constitute 9 candidate codevectors $A_k$ (see 505 in FIG. 5).

The purpose of step 610 is to compare the 9 candidate codevectors $A_k$ and select the best one according to the selection criterion associated with the last level, namely $Q_k(10)$.

We continue with a third instance of the depth-first codebook search called "Search technique #3" with the purpose of illustrating a case where more than one pulses are allowed to occupy the same position.

SEARCH TECHNIQUE #3, 10 pulses or less
Algebraic Codebook

L = 40; N = 10
Number of distinct pulses ≦ 10
Sum of two ISPP(40,5)
(i.e.: $L_1 = L_2 = \ldots L_5 = 8$; $L_6 = L_7 = \ldots L_{10} = 8$).
Search procedure:

| level m | Number of pulses, $N_m$ | Candidate paths | Pulse-order rule | Selection Criterion |
|---|---|---|---|---|
| 1 | 2 | 50 | R5 | B |
| 2 | 2 | 2 | R6 | $Q_k$ (4) |
| 3 | 2 | 2 | R6 | $Q_k$ (6) |
| 4 | 2 | 1 | R6 | $Q_k$ (8) |
| 5 | 2 | 1 | R6 | $Q_k$ (10) |

Rule R5:

Note that two pulses can occupy the same position therefore their amplitude add together to give a double-amplitude pulse. Rule R5 determines the way in which the first two pulse positions are selected in order to provide the set of level-1 candidate paths. The $$\binom{5}{1} + \binom{10}{2} = 50$$

nodes of level-1 candidate paths correspond to one double-amplitude pulse at each of the position maximizing $B_p$ in the five distinct tracks, and, all combinations of two pulse positions from the pool of 10 pulse positions selected by picking the two positions maximizing $B_p$ in each of the five distinct tracks.

Rule R6: Similar to Rule R4.

Although preferred embodiments of the present invention have been described in detail herein above, these embodiments can be modified at will, within the scope of the appended claims, without departing from the nature and spirit of the invention. Also the invention is not limited to the treatment of a speech signal; other types of sound signal such as audio can be processed. Such modifications, which retain the basic principle, are obviously within the scope of the subject invention.

What is claimed is:

1. A method of encoding a sound signal, comprising the steps of:

providing a codebook circuit for forming a codebook including a set of codevectors $A_k$ each defining a plurality of different positions p and comprising N non-zero-amplitude pulses each assignable to predetermined valid positions p of the codevector;

providing a device for conducting in said codebook a depth-first search involving a tree structure defining a number M of ordered levels, each level m being associated with a predetermined number $N_m$ of non-zero-amplitude pulses, $N_m \geqq 1$, wherein the sum of said predetermined numbers associated with all said M levels is equal to the number N of the non-zero-amplitude pulses comprised in said codevectors, each level m of the tree structure being further associated with a path building operation, with a given pulse-order rule and with a given selection criterion;

wherein:

in a level 1 of the tree structure, the associated path-building operation comprises the following substeps:

choosing a number $N_1$ of said N non-zero-amplitude pulses in relation to the associated pulse-order rule;

selecting at least one of the valid positions p of said $N_1$ non-zero-amplitude pulses in relation to the associated selection criterion to define at least one level-1 candidate path;

in a level m of the tree structure, the associated path-building operation defines recursively a level-m candidate path by extending a level-(m−1) candidate path through the following substeps:

choosing $N_m$ of said non-zero-amplitude pulses not previously chosen in the course of building said level-(m−1) path in relation to the associated pulse-order rule;

selecting at least one of the valid positions p of said $N_m$ non-zero-amplitude pulses in relation to the associated selection criterion to form at least one level-m candidate path; and wherein a level-M candidate path originated at a level-1 and extended during the path-building operations associated with subsequent levels of the tree structure determines the respective positions p of the N non-zero-amplitude pulses of a codevector and thereby defines a candidate codevector $A_k$.

2. A method of encoding a sound signal, comprising the steps of:

providing a codebook circuit for forming a codebook including a set of codevectors $A_k$ each defining a plurality of different positions p and comprising N non-zero-amplitude pulses each assignable to predetermined valid positions p of the codevector;

providing a device for conducting in said codebook a depth-first search involving (a) a partition of the N non-zero-amplitude pulses into a number M of subsets each comprising at least one non-zero-amplitude pulse, and (b) a tree structure including nodes representative of the valid positions p of the N non-zero-amplitude pulses and defining a plurality of search levels each associated to one of the M subsets, each search level being further associated to a given pulse-ordering rule and to a given selection criterion;

said depth-first search conducting step itself comprising the steps of:

in a first search level of the tree structure, choosing at least one of said N non-zero-amplitude pulses in relation to ,the associated pulse-ordering rule to form the associated subset;

selecting at least one of the valid positions p of said at least one non-zero-amplitude pulse in relation to the associated selection criterion to define at least one path through the nodes of the tree structure;

in each subsequent search level of the tree structure, choosing at least one of said non-zero-amplitude pulses not previously chosen in relation to the associated pulse-ordering rule to form the associated subset; and selecting at least one of the valid positions p of said at least one non-zero-amplitude pulse of the associated subset in relation to the associated selection criterion to extend said at least one path through the nodes of the tree structure;

wherein each path defined at the first search level and extended during the subsequent search levels determines the respective positions p of the N non-zero-amplitude pulses of a codevector $A_k$ constituting a candidate codevector in view of encoding the sound signal.

3. A sound signal encoding method as recited in claim 2, wherein said at least one path comprises a plurality of paths, wherein said search levels of the tree structure include a last search level, and wherein said depth-first search conducting step comprises, in the last search level of the tree structure, the step of selecting in relation to the associated selection criterion one of the candidate codevectors $A_k$ defined by said paths in view of encoding the sound signal.

4. A sound signal encoding method as recited in claim 2, further comprising the step of deriving the predetermined valid positions p of the N non-zero-amplitude pulses in accordance with at least one interleaved single-pulse permutation design.

5. A sound signal encoding method as recited in claim 2, wherein, in each said subsequent search level of the tree structure, the selecting step comprises:

calculating a given mathematical ratio for each path defined by the pulse position(s) p selected in the former search level(s) and extended by each valid position p of said at least one pulse of the subset associated to said subsequent search level; and retaining the extended path defined by the pulse positions p that maximize said given ratio.

6. A sound signal encoding method as recited in claim 2, wherein, at the first search level of the tree structure, the choosing and selecting steps are carried out by:

calculating a pulse-position likelihood-estimate vector in relation to the sound signal; and selecting said at least one non-zero-amplitude pulse of the associated subset and said at least one valid position p thereof in relation to said pulse-position likelihood-estimate vector.

7. A sound signal encoding method as recited in claim 6, wherein the step of calculating the pulse-position likelihood-estimate vector comprises the steps of:

processing the sound signal to produce a target signal X, a backward-filtered target signal D and a pitch-removed residual signal R'; and calculating the pulse-position likelihood-estimate vector B in response to at least one of said target signal X, backward-filtered target signal D and pitch-removed residual signal R'.

8. A sound signal encoding method as recited in claim 7, wherein the step of calculating the pulse-position likelihood-estimate vector B in response to at least one of said target signal X, backward-filtered target signal D and pitch-removed residual signal R' comprises:

summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain a pulse-position likelihood-estimate vector B of the form:

$$B=(1-\beta)\frac{D}{\|D\|}+\beta\frac{R'}{\|R'\|}$$

where β is a fixed constant.

9. A sound signal encoding method as recited in claim 8, wherein β is a fixed constant having a value situated between 0 and 1.

10. A sound signal encoding method as recited in claim 9, wherein β is a fixed constant having a value of ½.

11. A sound signal encoding method as recited in claim 2, wherein said N non-zero-amplitude pulses have respective indexes, and wherein, in each said subsequent search level of the tree structure, the step of choosing at least one of said non-zero-amplitude pulses not previously chosen in relation to the associated pulse-ordering function comprises laying out the indexes of the pulses not previously chosen on a circle and choosing said at least one non-zero-amplitude pulse in accordance with a clockwise sequence of the indexes starting at the right of the last non-zero-amplitude pulse selected in the former search level of the tree structure.

12. A system for encoding a sound signal, comprising:

a codebook including a set of codevectors $A_k$ each defining a plurality of different positions p and comprising N non-zero-amplitude pulses each assignable to predetermined valid positions p of the codevector;

a device for conducting in said codebook a depth-first search involving (a) a partition of the N non-zero-amplitude pulses into a number M of subsets each comprising at least one non-zero-amplitude pulse, and (b) a tree structure including nodes representative of the valid positions p of the N non-zero-amplitude pulses and defining a plurality of search levels each associated to one of the M subsets, each search level being further associated to a given pulse-ordering rule and to a given selection criterion;

said depth-first codebook search conducting device comprising:

for a first search level of the tree structure, first means for choosing at least one of said N non-zero-amplitude pulses in relation to the associated pulse-ordering rule to form the associated subset;

first means for selecting at least one of the valid positions p of said at least one non-zero-amplitude pulse in relation to the associated selection criterion to define at least one path through the nodes of the tree structure;

for each subsequent search level of the tree structure, second means for choosing at least one of said non-zero-amplitude pulses not previously chosen in relation to the associated pulse-ordering function to form the associated subset; and second means for selecting, in said subsequent search level, at least one of the valid positions p of said at least one non-zero-amplitude pulse of the associated subset in relation to the associated selection criterion to extend said at least one path through the nodes of the tree structure;

wherein each path defined at the first search level and extended during the subsequent search levels determines the respective positions p of the N non-zero-amplitude pulses of a codevector $A_k$ constituting a candidate codevector in view of encoding the sound signal.

13. A sound signal encoding system as recited in claim 12, wherein said at least one path comprises a plurality of paths, wherein said search levels of the tree structure include a last search level, and wherein said device comprises means for selecting, in the last search level of the tree structure and in relation to the associated selection criterion, one of the candidate codevectors $A_k$ defined by said paths in view of encoding the sound signal.

14. A sound signal encoding system as recited in claim 12, further comprising means for deriving the predetermined valid positions p of the N non-zero-amplitude pulses in accordance with at least one interleaved single-pulse permutation design.

15. A sound signal encoding system as recited in claim 12, wherein said second selecting means comprises:

means for calculating a given mathematical ratio for each path defined by the pulse position(s) p selected in the former search level(s) and extended by each valid position p of said at least one pulse of the subset associated to said subsequent search level; and means for retaining the extended path defined by the pulse positions p that maximize said given ratio.

16. A sound signal encoding system as recited in claim 12, wherein the first choosing means and the first selecting means comprise:

means for calculating a pulse-position likelihood-estimate vector in relation to the sound signal; and means for selecting said at least one non-zero-amplitude pulse of the associated subset and said at least one valid position p thereof in relation to said pulse-position likelihood-estimate vector.

17. A sound signal encoding system as recited in claim 16, wherein said means for calculating the pulse-position likelihood-estimate vector comprises:

means for processing the sound signal to produce a target signal X, a backward-filtered target signal D and a pitch-removed residual signal R'; and means for calculating the pulse-position likelihood-estimate vector B in response to at least one of said target signal X, backward-filtered target signal .D and pitch-removed residual signal R'.

18. A sound signal encoding system as recited in claim 17, wherein said means for calculating the pulse-position likelihood-estimate vector B in response to at least one of said target signal X, backward-filtered target signal D and pitch-removed residual signal R' comprises:

means for summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain a pulse-position likelihood-estimate vector B of the form:

$$B=(1-\beta)\frac{D}{\|D\|}+\beta\frac{R'}{\|R'\|}$$

where β is a fixed constant.

19. A sound signal encoding system as recited in claim 18, wherein β is a fixed constant having a value situated between 0 and 1.

20. A sound signal encoding system as recited in claim 19, wherein β is a fixed constant having a value of ½.

21. A sound signal encoding system as recited in claim 12, wherein said N non-zero-amplitude pulses have respective indexes, and wherein said second choosing means comprises:

means for laying out the indexes of the pulses not previously chosen on a circle; and means for choosing said at least one non-zero-amplitude pulse in accordance with a clockwise sequence of the indexes starting at the right of the last non-zero-amplitude pulse selected in the former search level of the tree structure.

22. A cellular communication system for servicing a large geographical area divided into a plurality of cells, comprising:

mobile transmitter/receiver units;

cellular base stations respectively situated in said cells;

means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means comprises a device for conducting a depth-first search in a codebook in view of encoding a sound signal, wherein:

said codebook comprises a set of codevectors $A_k$ each defining a plurality of different positions p and comprising N non-zero-amplitude pulses each assignable to predetermined valid positions p of the codevector;

said depth-first search involves (a) a partition of the N non-zero-amplitude pulses into a number M of subsets each comprising at least one non-zero-amplitude pulse, and (b) a tree structure including nodes representative of the valid positions p of the N non-zero-amplitude pulses and defining a plurality of search levels each associated to one of the M subsets, each search level being further associated to a given pulse-ordering rule and to a given selection criterion;

said depth-first codebook search conducting device comprising:

for a first search level of the tree structure, first means for choosing at least one of said N non-zero-amplitude pulses in relation to the associated pulse-ordering rule to form the associated subset;

first means for selecting at least one of the valid positions p of said at least one non-zero-amplitude pulse in relation to the associated selection criterion to define at least one path through the nodes of the tree structure;

for each subsequent search level of the tree structure, second means for choosing at least one of said non-zero-amplitude pulses not previously chosen in relation to the associated pulse-ordering function to form the associated subset; and second means for selecting, in said subsequent search level, at least one of the valid positions p of said at least one non-zero-amplitude pulse of the associated subset in relation to the associated selection criterion to extend said at least one path through the nodes of the tree structure;

wherein each path defined at the first search level and extended during the subsequent search levels determines the respective positions p of the N non-zero-amplitude pulses of a codevector $A_k$ constituting a candidate codevector in view of encoding the sound signal.

23. The cellular communication system of claim 22, wherein said at least one path comprises a plurality of paths, wherein said search levels of the tree structure include a last search level, and wherein said device comprises means for selecting, in the last search level of the tree structure and in relation to the associated selection criterion, one of the candidate codevectors $A_k$ defined by said paths in view of encoding the sound signal.

24. The cellular communication system of claim 22, further comprising means for deriving the predetermined valid positions p of the N non-zero-amplitude pulses in accordance with at least one interleaved single-pulse permutation design.

25. The cellular communication system of claim 22, wherein said second selecting means comprises:

means for calculating a given mathematical ratio for each path defined by the pulse position(s) p selected in the former search level(s) and extended by each valid position p of said at least one pulse of the subset associated to said subsequent search level; and means for retaining the extended path defined by the pulse positions p that maximize said given ratio.

26. The cellular communication system of claim 22, wherein the first choosing means and the first selecting means comprise:

means for calculating a pulse-position likelihood-estimate vector in relation to the sound signal; and means for selecting said at least one non-zero-amplitude pulse of the associated subset and said at least one valid position p thereof in relation to said pulse-position likelihood-estimate vector.

27. The cellular communication system of claim 26, wherein said means for calculating the pulse-position likelihood-estimate vector comprises:

means for processing the sound signal to produce a target signal X, a backward-filtered target signal D and a pitch-removed residual signal R'; and means for calculating the pulse-position likelihood-estimate vector B in response to at least one of said target signal X, backward-filtered target signal D and pitch-removed residual signal R'.

28. The cellular communication system of claim 27, wherein said means for calculating the pulse-position likelihood-estimate vector B in response to at least one of said target signal X, backward-filtered target signal D and pitch-removed residual signal R' comprises:

means for summing the backward-filtered target signal D in normalized form:

$$(1-\beta)\frac{D}{\|D\|}$$

to the pitch-removed residual signal R' in normalized form:

$$\beta\frac{R'}{\|R'\|}$$

to thereby obtain an amplitude estimate vector B of the form:

$$B=(1-\beta)\frac{D}{\|D\|}+\beta\frac{R'}{\|R'\|}$$

where β is a fixed constant.

29. The cellular communication system of claim 28, wherein β is a fixed constant having a value situated between 0 and 1.

30. The cellular communication system of claim 29, wherein β is a fixed constant having a value of ½.

31. The cellular communication system of claim 22, wherein said N non-zero-amplitude pulses have respective indexes, and wherein said second choosing means comprises:

means for laying out the indexes of the pulses not previously chosen on a circle; and means for choosing said at least one non-zero-amplitude pulse in accordance with a clockwise sequence of the indexes starting at the right of the last non-zero-amplitude pulse selected in the former search level of the tree structure.

* * * * *

UNITED STATES PATENT AND TRADEMARK OFFICE

CERTIFICATE OF CORRECTION

PATENT NO. : 5,701,392

DATED : DECEMBER 23, 1997

INVENTOR(S) : ADOUL ET AL.

It is certified that error appears in the above-identified patent and that said Letters Patent is hereby corrected as shown below:

Col. 9, line 51: "h(n)=1" should read —h(n)=0—

Col. 10, line 1: "$\|S''-\hat{S}''\|$" should read —$\|S'-\hat{S}'\|$—

Col. 20, line 63, claim 17: delete "." after the word "signal"

Signed and Sealed this

Twenty-second Day of February, 2000

*Attest:*

Q. TODD DICKINSON

*Attesting Officer*

*Commissioner of Patents and Trademarks*

US005701392C1

(12) EX PARTE REEXAMINATION CERTIFICATE (5475th)

United States Patent
Adoul et al.

(10) Number: US 5,701,392 C1
(45) Certificate Issued: Aug. 15, 2006

(54) DEPTH-FIRST ALGEBRAIC-CODEBOOK SEARCH FOR FAST CODING OF SPEECH

(75) Inventors: Jean-Pierre Adoul, Sherbrooke (CA); Claude Laflamme, Sherbrooke (CA)

(73) Assignee: Universite de Sherbrooke, Sherbrooke (CA)

Reexamination Request:
No. 90/007,200, Sep. 13, 2004

Reexamination Certificate for:

| | |
|---|---|
| Patent No.: | **5,701,392** |
| Issued: | **Dec. 23, 1997** |
| Appl. No.: | **08/509,525** |
| Filed: | **Jul. 31, 1995** |

Certificate of Correction issued Feb. 22, 2000.

Related U.S. Application Data

(63) Continuation-in-part of application No. 08/401,785, filed on Mar. 10, 1995, which is a continuation-in-part of application No. 07/927,528, filed as application No. PCT/CA90/00381 on Nov. 6, 1990, now Pat. No. 5,444,816.

(30) Foreign Application Priority Data

Feb. 23, 1990 (CA) ..... 2010830

(51) Int. Cl.
*G10L 19/10* (2006.01)

(52) U.S. Cl. ..... 704/219; 704/223; 704/262; 704/201.1

(58) Field of Classification Search ..... 704/201, 704/219, 223, 220, 262, 201.1
See application file for complete search history.

(56) References Cited

U.S. PATENT DOCUMENTS

| | | | |
|---|---|---|---|
| 5,444,810 | A | 8/1995 | Szegda |
| 5,444,816 | A | 8/1995 | Adoul et al. |
| 5,444,818 | A | 8/1995 | Lisle |
| 5,621,852 | A | 4/1997 | Lin |
| 5,754,976 | A | 5/1998 | Adoul et al. |

FOREIGN PATENT DOCUMENTS

| | | |
|---|---|---|
| EP | 0 195 487 A1 | 9/1986 |
| EP | 0138061 | 6/1988 |
| EP | 0516621 | 3/1998 |
| EP | 0503684 | 7/1998 |
| EP | 0819303 | 1/2001 |
| GB | 2199215 | 6/1988 |
| WO | WO 90/13891 A1 | 11/1990 |
| WO | 91/13432 | 9/1991 |
| WO | 92/16930 | 10/1992 |
| WO | 96/24925 | 8/1996 |
| WO | 96/28810 | 9/1996 |

OTHER PUBLICATIONS

C. Xydeas, "An Overview of Speech Coding Techniques," IEEE Colloquium on Speech Coding, 1992, pp. Jan. 1–Jan. 25.

(Continued)

*Primary Examiner*—Vijay B. Chawan

(57) ABSTRACT

A codebook is searched in view of encoding a sound signal. This codebook consists of a set of codevectors each of 40 positions and comprising N non-zero-amplitude pulses assignable to predetermined valid positions. To reduce the search complexity, a depth-first search is used which involves a tree structure with levels ordered from 1 through M. A path-building operation takes place at each level whereby a candidate path from the previous level is extended by choosing a predetermined number of new pulses and selecting valid positions for said new pulses in accordance with a given pulse-order rule and a given selection criterion. A path originated at the first level and extended by the path-building operations of subsequent levels determines the respective positions of the N non-zero-amplitude pulse of a candidate codevector. Use of a signal-based pulse-position likelihood estimate during the first few levels enable initial pulse-screening to start the search on favorable conditions. A selection criterion based on maximizing a ratio is used to assess the progress and to choose the best one among competing candidate codevectors.

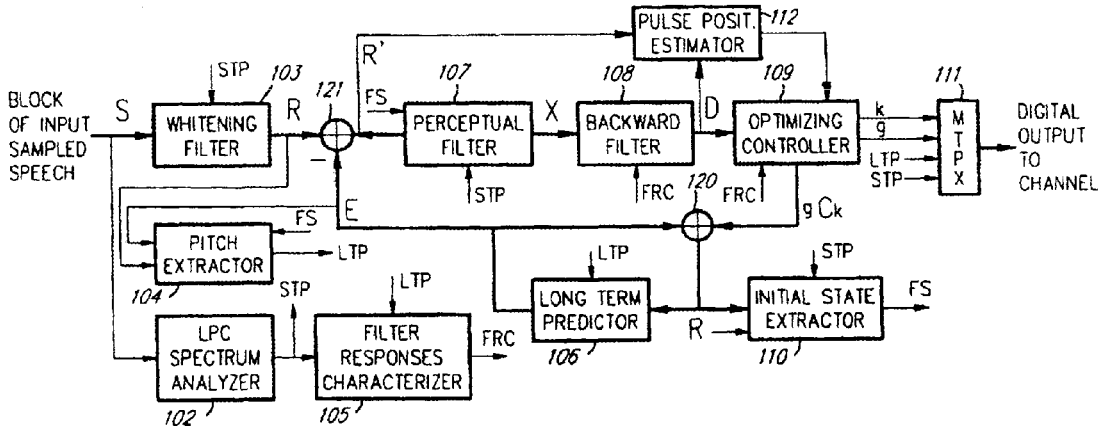

OTHER PUBLICATIONS

A. W. Lang, "Solving a Class of Nonlinear Least Squares Problems," IEEE, Proc. ICASSP, CH2118–8/85, pp. 9.3.1–9.3.4.

M. Berouti et al., "Efficient Computation and Encoding of Multipulse LPC," IEEE, Proc. ICASSP, CH1945–5/84, pp. 10.1.1–10.1.4.

S. Singhal, "Reducing Computation in Optimal Amplitude Mulipulse Coders," IEEE, Proc. ICASSP, CH2243–4/86, pp. 44.2.1–44.2.4.

R. Salami et al., "A Toll Quality 8kb/s Speech Codec for the Personal Communications System (PCS)," IEEE Trans. on Vehicular Technology, vol. 43, No. 3, Aug. 1994, pp. 808–816.

M. E. Ahmed et al., "Fast methods for code search in CELP," IEEE Transactions on Speech and Audio Processing, vol. 1, No. 3, Jul. 1993, pp. 315–325.

B.S. Atal et al., "A New Model of LPC Excitation for Producing Natural–Sounding Speech at Low Bit Rates", Proc. IEEE International Conference on Acoustics, Speech and Signal Proc., Paris, France 1980, pp. 614–617.

A. Gersho, "Advances in Speech and Audio Compression," Proc. of the IEEE, vol. 82, No. 6, Jun. 1994, pp. 900–918.

R. Salami et al., "8Kbit/s ACELP Coding of Speech with 10 ms Speech Frame: A Candidate for CCITT Standardisation," IEEE, 1994, pp. II–97 to II–100.

Kodratoff et al., "Base terminologique de l'intelligence artificielle," Technique et documentation, Lavoisier, Paris 27 mai 1991, XP 002046534, one sheet.

A. Gersho et al., "Vector Quantization and Signal Compression," Academic Publishers, 1992, pp. 407–481.

R. Steel, "Mobile Radio Communication," Pentech Press Publishers, 1992, pp. 186–346.

Salami et al, "Real–Time Implementation of a 9.6 Kbit/s ACELP Wideband Speech Coder," IEEE Global Telecomm. Conf., Orlando, FL, Dec. 6–9, 1992, vol. 1, pp. 447–451.

Sanchez–Calle et al, "Low–delay algebraic CELP coding of wideband speech," in Signal Processing VI: Theories and App'ns, Proc. of EUSIPCO–92, Aug. 24–27, 1992, pp. 495–498.

Dembo et al, "A new approach to multipulse LPC coder design," Proc. Int'l Conf. Acoustics, Speech and Signal Process., Mar. 1985, pp. 949–952.

Singhal et al, "Amplitude Optimization and Pitch Prediction in Multipulse Coders," IEEE Trans. on Acoustics, Speech & Signal Processing, vol. 37, No. 3, Mar. 1989, pp. 317–327.

Davidson et al, "Multiple–stage vector excitation coding of speech waveforms," Proc. Int'l Conf. Acoustics, Speech, and Signal Process., Apr. 1988, pp. 163–166.

Moreau et al, "Selection of Excitation Vectors for the CELP Coders," IEEE Trans. on Speech and Audio Processing, vol. 2, No. 1, Part 1, Jan. 1994, pp. 29–41.

Laflamme et al, "16 kbps wideband speech coding technique based on algebraic CELP," Proc. Int'l Conf. Acoustics, Speech and Signal Process., May 1991, pp. 13–16.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–31 is confirmed.

* * * * *